US012275576B2

(12) United States Patent
Gourdier, Jr.

(10) Patent No.: US 12,275,576 B2
(45) Date of Patent: Apr. 15, 2025

(54) REMOTELY OPERATED VALVE ASSEMBLY FOR PRESSURIZED FLUID CONTAINER

(71) Applicant: John William Gourdier, Jr., Glen Mills, PA (US)

(72) Inventor: John William Gourdier, Jr., Glen Mills, PA (US)

( * ) Notice: Subject to any disclaimer, the term of this patent is extended or adjusted under 35 U.S.C. 154(b) by 808 days.

(21) Appl. No.: 17/422,313

(22) PCT Filed: Jan. 16, 2020

(86) PCT No.: PCT/US2020/013878

§ 371 (c)(1),
(2) Date: Jul. 12, 2021

(87) PCT Pub. No.: WO2020/150471

PCT Pub. Date: Jul. 23, 2020

(65) Prior Publication Data

US 2022/0089356 A1 Mar. 24, 2022

Related U.S. Application Data

(60) Provisional application No. 62/792,943, filed on Jan. 16, 2019.

(51) Int. Cl.

| | |
|---|---|
| ***B65D 83/20*** | (2006.01) |
| ***B65D 83/26*** | (2006.01) |
| ***B65D 83/68*** | (2006.01) |

(52) U.S. Cl.

CPC ..... *B65D 83/68* (2013.01); *B65D 83/20* (2013.01); *B65D 83/26* (2013.01)

(58) Field of Classification Search

CPC ..... B65D 83/756; B65D 83/207; B65D 83/68
See application file for complete search history.

(56) References Cited

U.S. PATENT DOCUMENTS

| | | | | | |
|---|---|---|---|---|---|
| 2,720,422 | A | * | 10/1955 | Mercur | B65D 83/203 222/394 |
| 3,305,144 | A | * | 2/1967 | Beres | B65D 83/756 251/95 |
| 3,401,838 | A | * | 9/1968 | Hanson, Jr. | B65D 83/60 222/136 |
| 3,428,224 | A | * | 2/1969 | Douglas | B65D 83/756 222/529 |
| 3,506,159 | A | * | 4/1970 | Muller | B65D 83/202 222/323 |

(Continued)

OTHER PUBLICATIONS

Written Opinion of the International Searching Authority of the corresponding PCT application PCT/US20/13878; dated Mar. 31, 2020.*

(Continued)

*Primary Examiner* — Paul R Durand
*Assistant Examiner* — Randall A Gruby
(74) *Attorney, Agent, or Firm* — Joseph E. Maenner; Petock & Petock LLC

(57) ABSTRACT

A nozzle assembly provides an adapter configured for insertion into a pressurized container, wherein a nozzle has been removed from the pressurized container. A tubing has a first end connected to the adapter and a second end. A discharge nozzle is releasably connected to the second end of the tubing.

16 Claims, 8 Drawing Sheets

(56) References Cited

U.S. PATENT DOCUMENTS 3,559,890 A * 2/1971 Brooks ..... E04F 21/12 239/304
3,575,319 A * 4/1971 Safianoff ..... B65D 83/682 222/459
3,613,956 A * 10/1971 McCulloch ..... B65D 83/756 229/199
3,650,438 A * 3/1972 Stephenson ..... B65D 83/756 222/402.22
3,716,195 A 2/1973 Silva
3,756,512 A * 9/1973 Dyal ..... B65D 83/756 239/394
3,777,944 A * 12/1973 Brooks ..... B65D 83/48 222/394
3,871,557 A 3/1975 Smart
4,089,440 A * 5/1978 Lee ..... B65D 83/203 222/509
4,278,188 A * 7/1981 Stephenson ..... B65D 83/285 285/200
4,350,299 A * 9/1982 Stephenson ..... B65D 83/756 239/588
4,496,081 A * 1/1985 Farrey ..... B65D 83/207 239/304
4,579,258 A 4/1986 Brown et al.
4,682,713 A * 7/1987 Clapp ..... B65D 83/303 239/574
4,880,143 A * 11/1989 Murray ..... B65D 83/682 222/323
4,895,190 A * 1/1990 Gillen ..... B65D 83/303 141/346
4,895,280 A 1/1990 Tourigny
4,902,281 A * 2/1990 Avoy ..... B05B 1/26 222/137
4,928,859 A * 5/1990 Krahn ..... F16L 37/0841 285/317
4,958,750 A * 9/1990 Palmert ..... B65D 83/68 239/304
5,005,736 A * 4/1991 Portas ..... A01N 25/06 222/506
5,344,051 A * 9/1994 Brown ..... B29B 7/7447 222/323
5,529,226 A 6/1996 Alberth, Jr.
5,553,788 A * 9/1996 Del Gaone ..... B05B 1/3026 239/290
5,887,756 A 3/1999 Brown
5,924,599 A 7/1999 Brown
6,029,862 A 2/2000 Jones
6,294,022 B1 * 9/2001 Eslambolchi ..... E01C 23/22 118/305
6,308,899 B1 10/2001 Crofford
7,455,195 B2 * 11/2008 Mekata ..... B65D 83/68 222/105
7,484,676 B2 2/2009 Joseph et al.
7,798,429 B1 * 9/2010 Porter ..... B05B 7/2427 239/525
8,087,552 B2 1/2012 Fazekas et al.
8,430,272 B2 4/2013 Porter
8,453,944 B2 6/2013 Klein, II et al.
8,469,063 B2 6/2013 Speck
9,061,299 B1 * 6/2015 Fodor ..... B05B 1/207
9,651,178 B2 5/2017 Mason
10,065,791 B1 9/2018 Charles
10,538,351 B2 * 1/2020 Smith ..... B65B 31/003
10,799,901 B2 * 10/2020 Langsdale ..... B05B 12/02
11,180,308 B2 * 11/2021 Johnson ..... B65D 83/382
11,603,256 B2 * 3/2023 Smith ..... B65D 83/303
2005/0061014 A1 * 3/2005 Cannan ..... B60H 1/00585 62/77
2006/0011665 A1 * 1/2006 Garner ..... B65D 83/756 222/402.1
2006/0060614 A1 * 3/2006 Garner ..... B65D 83/75 222/402.1
2007/0131714 A1 * 6/2007 Jutras ..... B05B 9/007 222/174
2008/0135649 A1 6/2008 Smyth
2009/0308946 A1 12/2009 Dube et al.
2011/0240771 A1 * 10/2011 Legeza ..... B05B 15/652 239/588
2024/0383668 A1 * 11/2024 Ong ..... B05B 15/63

OTHER PUBLICATIONS

H.A.M.B. The spray can extension tube. www.jalopyjournal.com/forum/threads/sprys-can-extension-tube.866514/ Printed Oct. 16, 2018.
Fluid Film Spray Can Extension Wand. www.amazon.com. Printed Oct. 16, 2018.
Krylon K07091000 Snap and Spray Can Handle. www.amazon.com. Printed Oct. 15, 2018.

* cited by examiner

REMOTELY OPERATED VALVE ASSEMBLY FOR PRESSURIZED FLUID CONTAINER

BACKGROUND OF THE INVENTION

Field of the Invention

The present invention relates to a valve assembly that is used to remotely operate a pressurized fluid container, such as, for example, a can of spray paint.

Description of the Related Art

Pressurized containers, such as spray cans, typically provide a nozzle that is depressed to pen a valve inside the can and allow the pressurized fluid to be dispensed from the nozzle. Sometimes, however, it can be difficult to maneuver and aim a spray can in small confined spaces. Additionally, if a long continuous spray is desired, it can sometimes be difficult and tiring to keep the nozzle on a standard pressurized spray can depressed to effect the continuous discharge.

It would be beneficial to provide a remotely operated valve assembly that can be used to discharge fluid from a pressurized container.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a nozzle assembly comprising an adapter configured for insertion into a pressurized container, wherein a nozzle has been removed from the pressurized container and a tubing having a first end connected to the adapter and a second end. A discharge nozzle is connected to the second end of the tubing.

In an alternative embodiment, the present invention is a nozzle assembly comprising a nozzle assembly comprising an adapter having a hollow pin adapted to be inserted into a pressurized container, a flange connected to the hollow pin, and a distal end connected to the flange. A tubing includes a first end connected to the distal end and a second end. A discharge nozzle us connected to the second end of the tubing, such that the discharge nozzle is in fluid communication with the adapter through the tubing.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 1:
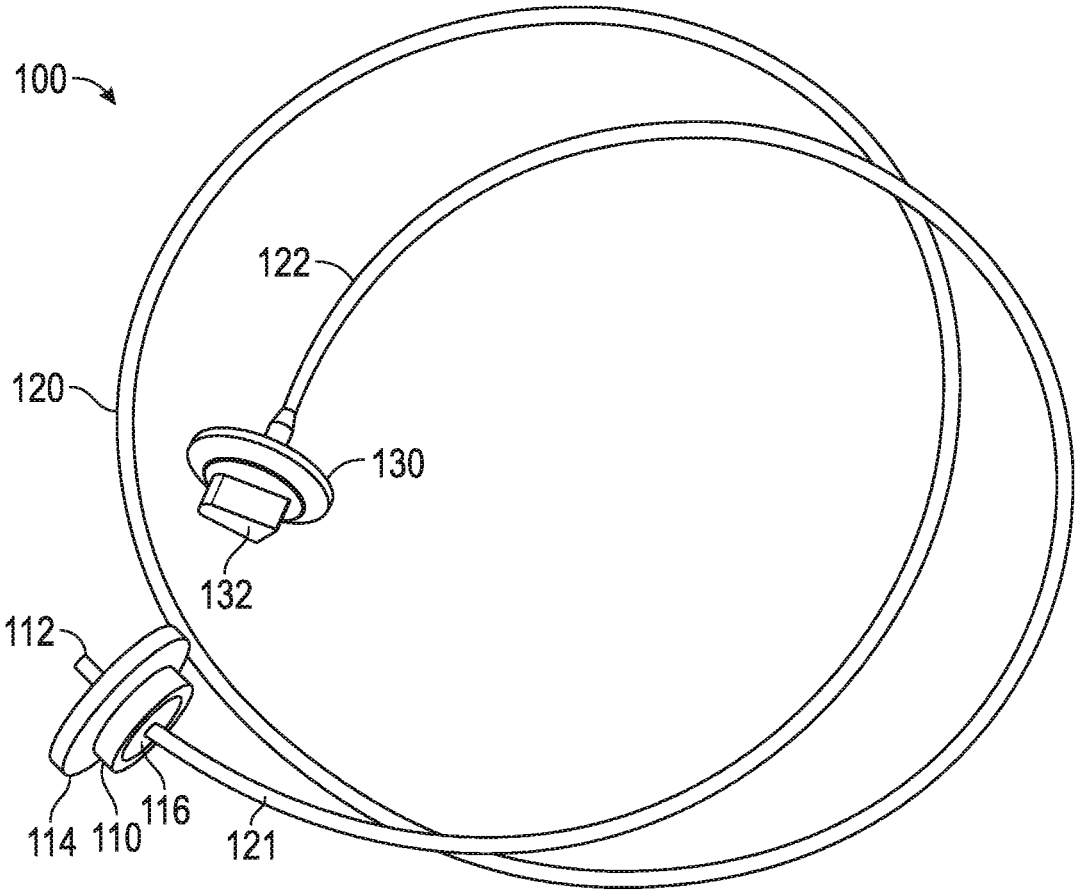
FIG. 1 is a top plan view of a valve assembly according to an exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

Referring to the Figures, the present invention includes an assembly 100 that can be attached to a can containing a pressurized fluid. The assembly includes an insert for inserting into the can, whose nozzle has been removed. The insert and can are insertable into an activating device, such as a caulking gun, that can be activated to force the insert into the can, opening an internal valve in the can so that pressurized fluid can be discharged from the can. A length of tubing extends from the insert to a discharge nozzle. The discharge nozzle is removably insertable into a trigger mechanism, such as a Krylon Snap and Spray Can Adapter, or other like trigger device. When the trigger is pulled, the device depresses onto the discharge nozzle, opening an internal valve in the nozzle, and allowing the fluid from the tubing to discharge from the nozzle. The nozzle can be removed from the tubing so that a different nozzle with a different spray pattern can be attached thereto.

Referring to FIG. 1, the assembly 100 includes an adapter 110 that has a proximal end 121 that is connected to a length of tubing 120. A distal end 122 of the tubing 120 is releasably connected to a discharge nozzle 130. Discharge nozzle 130 can be removed from tubing 120 so that a different discharge nozzle (not shown) having a different spray pattern than discharge nozzle 130, can be attached to tubing 120.

Adapter 110 includes a tubular hollow pin 112 that is sized to fit into the top of a pressurized container, such as a standard spray can 50 (shown in FIG. 2) with the nozzle removed. Pin 112 fits into the opening for the nozzle. Adapter 110 also includes a circular flange 114 that engages the front end 52 of a receiver 54. Adapter 110 also includes a distal end 116 that connects to proximal end 121 of tubing 120 and provides for fluid communication between tubing 120 and adapter 110.

Figure 2:
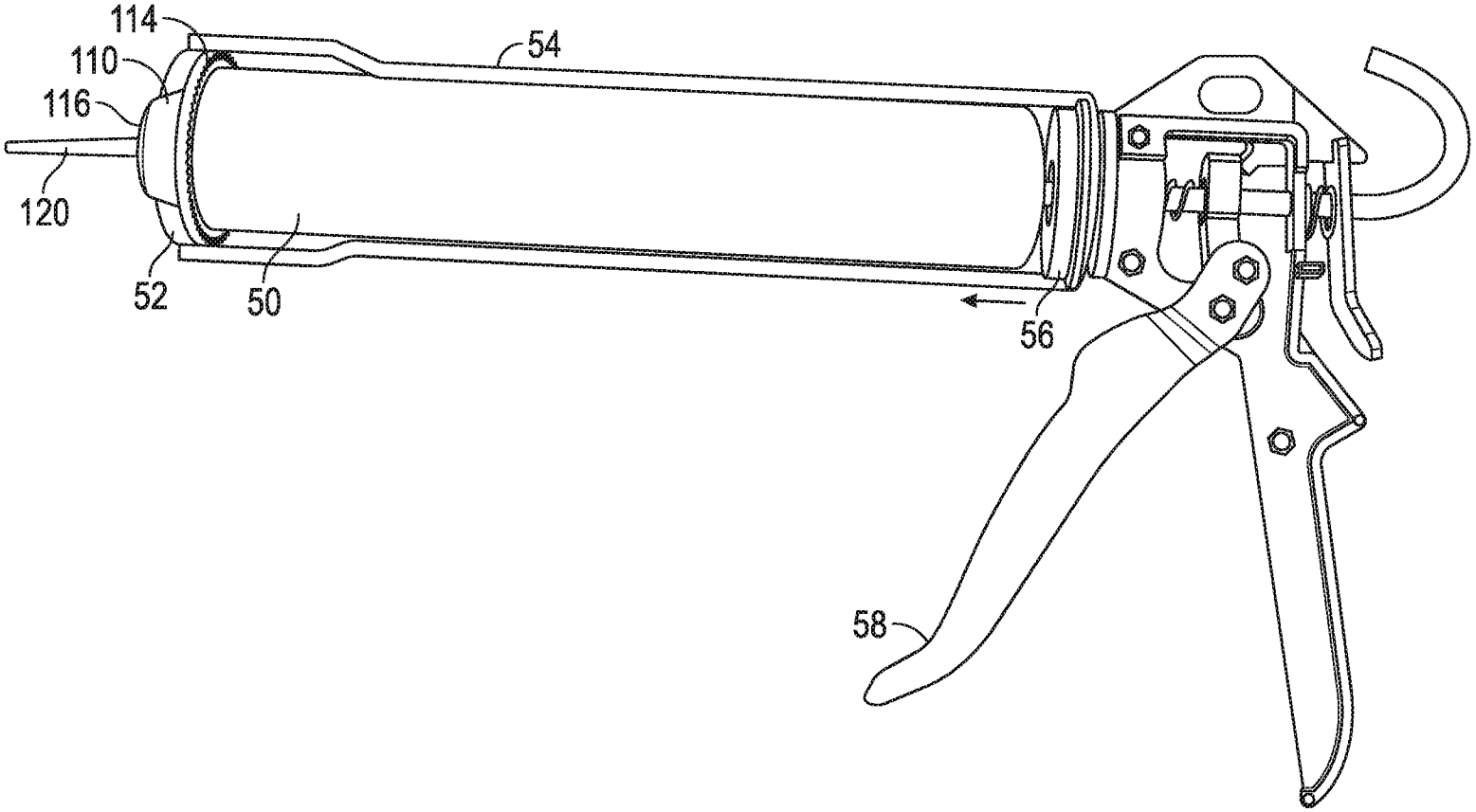
FIG. 2 is a side elevational view of the valve assembly of FIG. 1 attached to a pressurized spray can that is inserted into an activation device.

A standard caulking gun 58 is shown in FIG. 2, although a custom receiver 54 can be provided, as long as the receiver 54 includes a plunger 56 that can be advanced, such as to the left as indicated by the arrow in FIG. 2 to push adapter 110 up against front end 52 of receiver 54, to depress pin 112 into can 50 and open the valve in can 50 to allow fluid in can 50 to be discharged into the tubing 120. Optionally, instead of a caulking gun, a belt mounted receiver can be provided.

Figure 3:
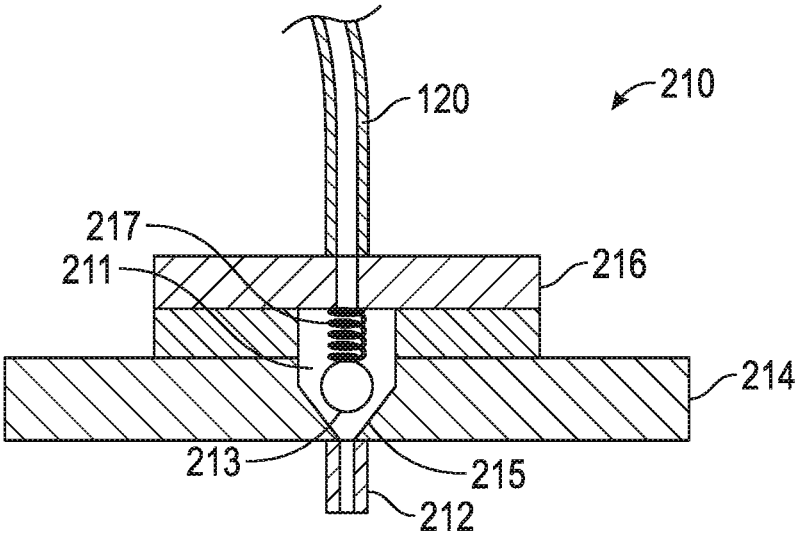
FIG. 3 is a sectional view of an alternative embodiment of an adapted for attachment to a pressurized can.

Optionally, as shown in FIG. 3, an adapter 210 can include a check valve 211 inside so that, when the adapter 210 is removed from the can 50, fluid from the tubing 120 does not backflow out of the adapter 210. Adapter 210 is similar to adapter 110 with a circular flange 214 and a pin 212 extending therefrom, as well as a distal end 212 that is connected to tubing 120.

Check valve 211 includes a ball 213 that is biased against a seat 215 by a biasing member 217, such as a spring. Pressurized fluid in can 50 has sufficient power to force ball 213 away from seat 215 to allow the pressurized fluid to flow past ball 213 and biasing member 217 for discharge to tubing 120. When adapter 210 is removed from can 50, biasing member 217 biases ball 213 against seat 215, preventing any fluid within tubing from dripping out past ball 213.

Figure 4:
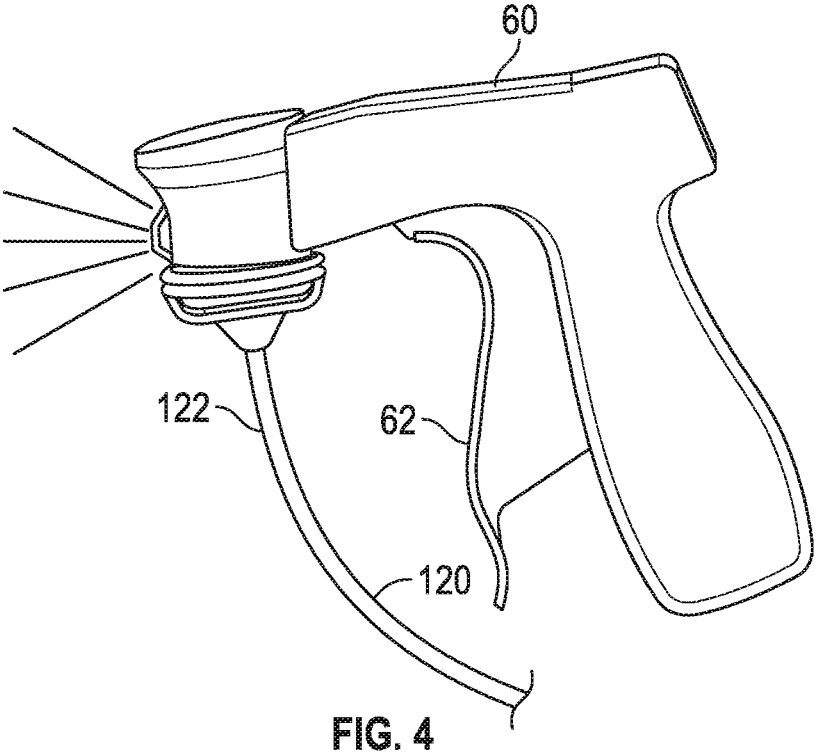
FIG. 4 is a perspective view of a discharge nozzle of the valve assembly of FIG. 1 attached to a trigger device.
Figure 5:
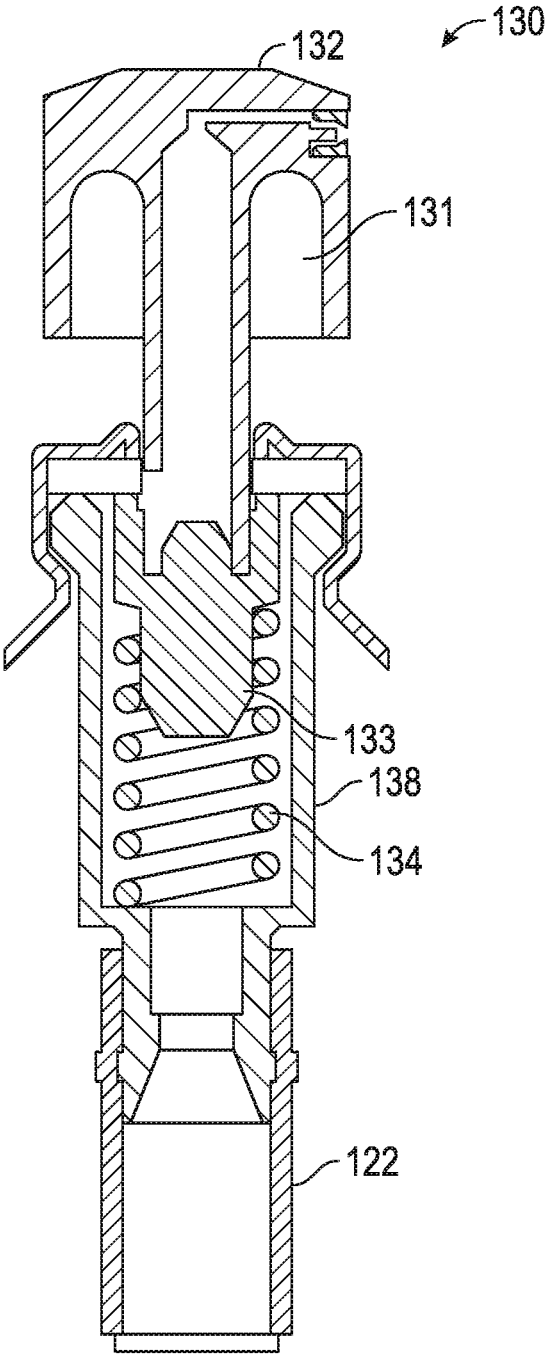
FIG. 5 is a sectional view of the discharge nozzle of the valve assembly of FIG. 1.

Discharge nozzle 130 is in fluid communication with distal end 122 of tubing and can by inserted into discharge device 60, such as a Krylon Snap & Spray gun (shown in FIG. 4). FIG. 5 is a sectional view of an exemplary embodiment of discharge nozzle 130. Nozzle 130 includes an actuator button 131 having top face 132. Actuator button 131 is inserted into a spring cup 133 that is biased to an upward, closed position by a biasing member 134, such as a helical spring, mounted in a valve housing 138. Valve housing 138 is connected to distal end 122 of tubing.

When the trigger 62 on the discharge device 60 is depressed, a lever (not shown) inside discharge device 60 pushes down on the top face 132 of nozzle 130, opening nozzle 130, and allowing the fluid from tubing 120 to discharge from nozzle 130.

Figure 6:
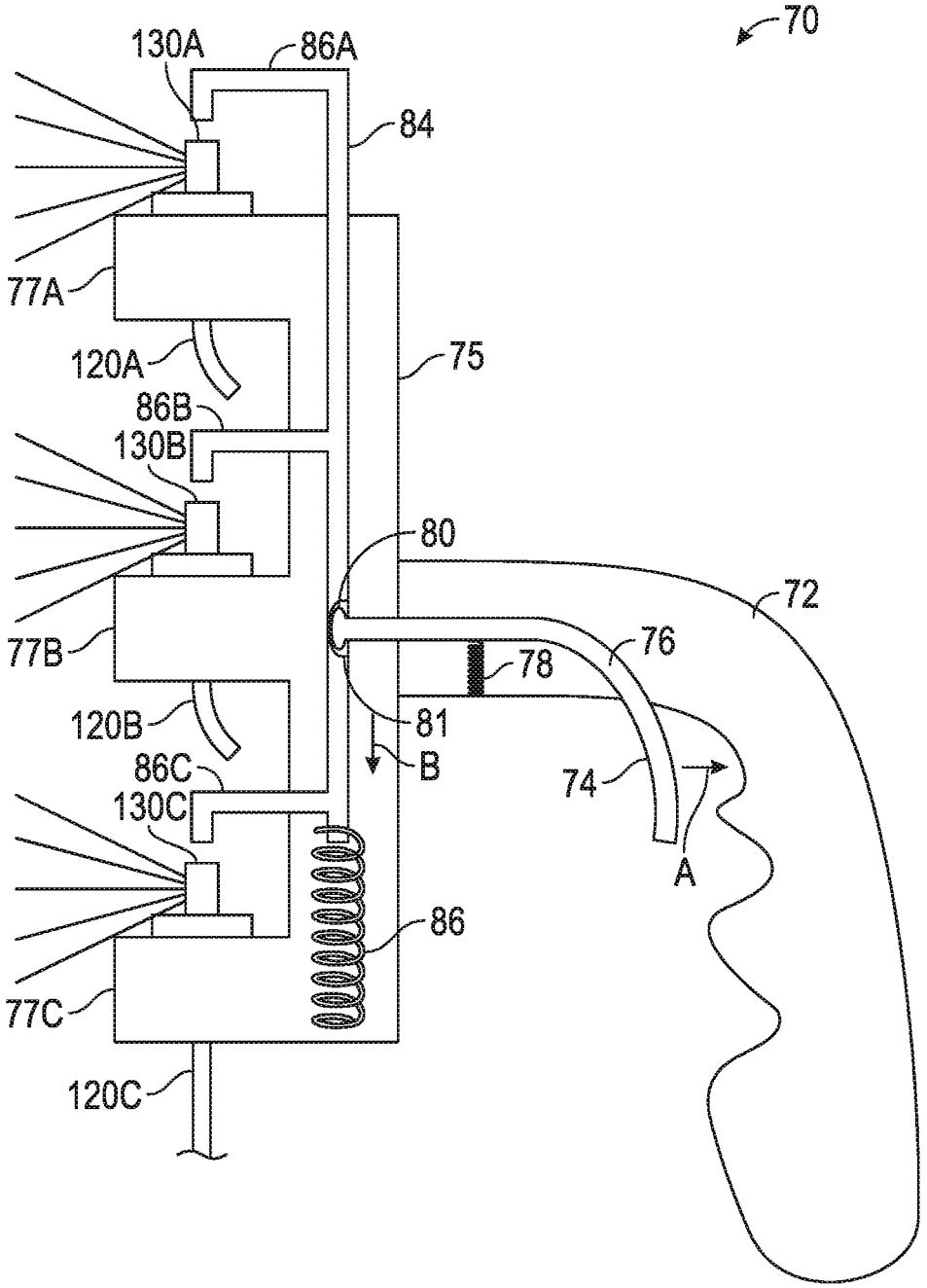
FIG. 6 is a side elevational view of an alternative embodiment of a trigger device that allows the discharge of multiple nozzles simultaneously.

An alternative embodiment of a discharge device 70 is shown in FIG. 6. discharge device 70 allows for the use of multiple nozzles 130A, 130B, 130C simultaneously to provide enhanced spray coverage. Although a discharge device that accommodates three nozzles 130A, 130B, 130C are shown, those skilled in the art will recognize that a discharge device that accommodates more or less than three nozzles 130A, 130B, 130C can be used.

Discharge device 70 includes a pistol grip handle 72 with a trigger 74. A manifold 75 is rotatably connected to handle 72 via trigger 74. Trigger 74 is mounted on a pivot pin 76 and biased to a forward position by a biasing member 78, such as, for example, a helical spring. A distal end 80 of trigger 74 has a ball that fits into a socket 82 in manifold 75 so that manifold 75 can rotate about ball 80 relative to handle 72.

Manifold 74 includes a like number of receivers 77A, 77B, 77C 86C as are nozzles 130A, 130B, 130C, with each nozzle 130A, 130B, 130C removably inserted into and releasably retained by a respective receiver 77A, 77B, 77C. Each receiver 77A, 77B, 77C includes a passage (not shown) to allow tubing 120A, 120B, 120C to extend therethrough, as shown in FIG. 6.

An activating rod 84 includes socket 82 and is biased in an upward direction by a biasing member 86, such as, for example, a helical spring. Activating rod 84 is operatively connected to trigger 74 such that, when trigger 74 is not compressed toward handle 72, activating rod 84 is in the location shown in FIG. 6. When trigger 74 is compressed toward handle 72 in the direction of arrow "A", activating rod 84 is depressed downwardly in the direction of arrow "B".

Activating rod 84 includes a like number of arms 86A, 86B, 86C as are nozzles 130A, 130B, 130C, with each arm 86A, 86B, 86C disposed over a respective nozzle 130A, 130B, 130C. When trigger 74 is compressed, activating rod 84 is pulled downwardly and each arm 86A, 86B, 86C depresses its respective nozzle 130A, 130B, 13C, discharging pressurized fluids from respective tubing 120A, 120B, 120C.

Figure 7:
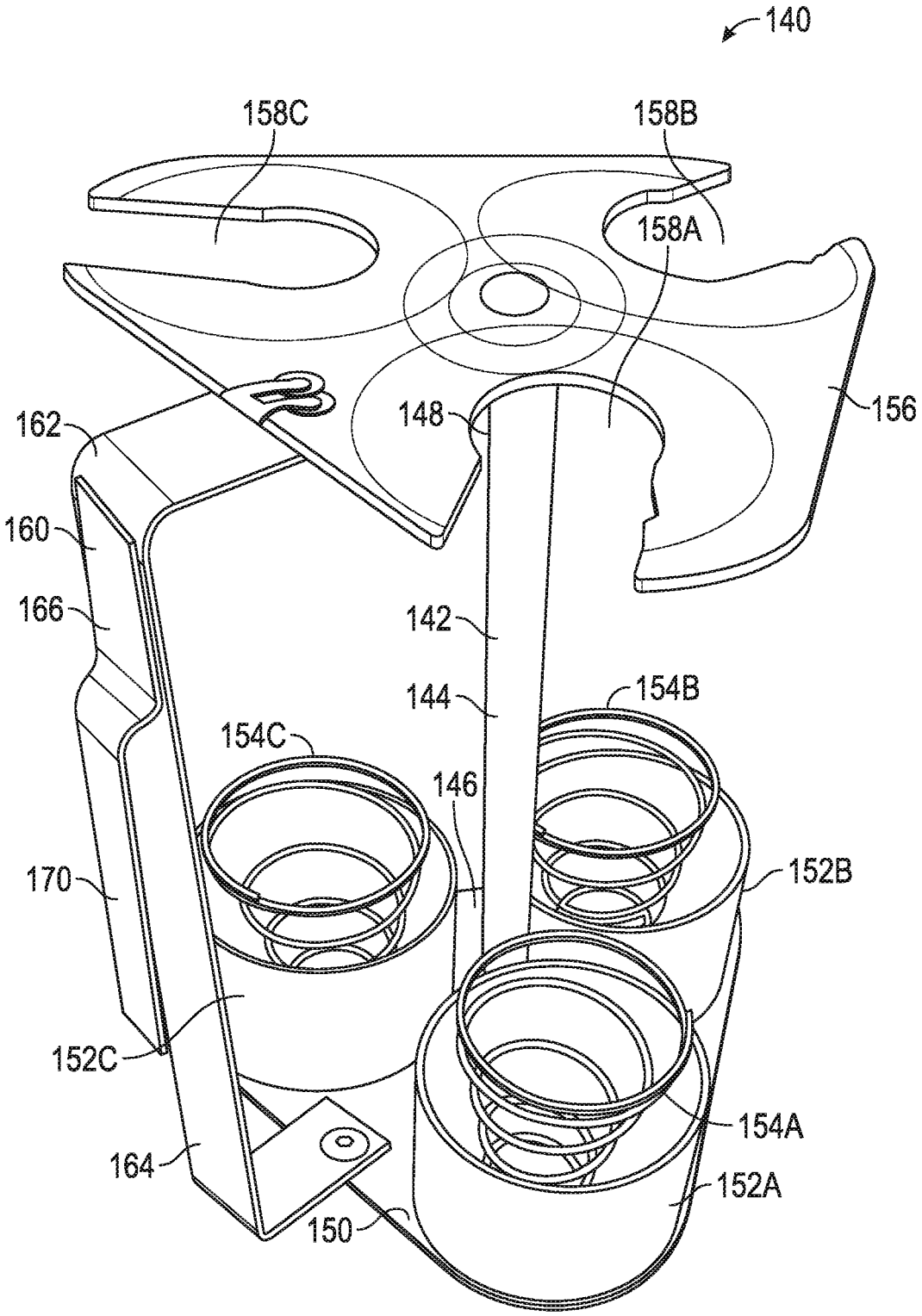
FIG. 7 is a perspective view of a carousel holder to retain paint cans used with the trigger device of FIG. 6.

Referring to FIG. 7, a carousel 140 can hold a like number of cans of pressurized fluid as nozzles 130A-130C. In this exemplary embodiment, carousel 140 can hold three cans (not shown). Carousel 140 includes a frame 142 having a central post 144 with a bottom end 146 and a top end 148.

Bottom end 146 supports a lower plate 150 that retains three cups 152A, 152B, 152C. Each cup 152A-152C has an inner diameter that is wide enough to receive the bottom of the can. Each cup 152A-152C also includes a respective biasing member 154A, 154B, 154C, such as a helical spring that biases the can upwardly.

Top end 148 supports an upper plate 156 having a plurality of cutouts 158A, 158B, 158C located directly above their respective cups 152A-152C. Cutouts 158A-158C are each open at a location distal from central post 144. Cutouts 158A-158C are large enough to allow the can to be inserted into a respective cutout 158A-158C, but small enough so that a portion of flange 114 on adapter 110 engages the underside of upper plate 156 such that, when a can is inserted into a cup 152A-152C, the respective biasing member 154A-154C biases the can upwardly against upper plate 156, pushing adapter 110 into the can to allow pressurized fluid from the can to flow through adapter 110 and into tubing 120 for ultimate discharge from nozzle 130.

Optionally, a belt receiver 160 can be attached to carousel 140. Belt receiver 160 includes a top portion 162 that is attached top upper plate 156 and a bottom portion 164 that is attached to lower plate 150. An elongate portion 166 extends between and connects top portion 162 and bottom portion 164. A belt arm 170 extends outwardly from elongate portion 166 and then turns downwardly parallel to elongate portion 166. The outward extension is far enough such that wearer's belt (not shown) can slide between elongate portion 166 and belt arm 170 so that the belt can support carousel 140, making it easier for the wearer to move around and use discharge device 70 to discharge fluid from the cans in carousel 140.

Figure 9:
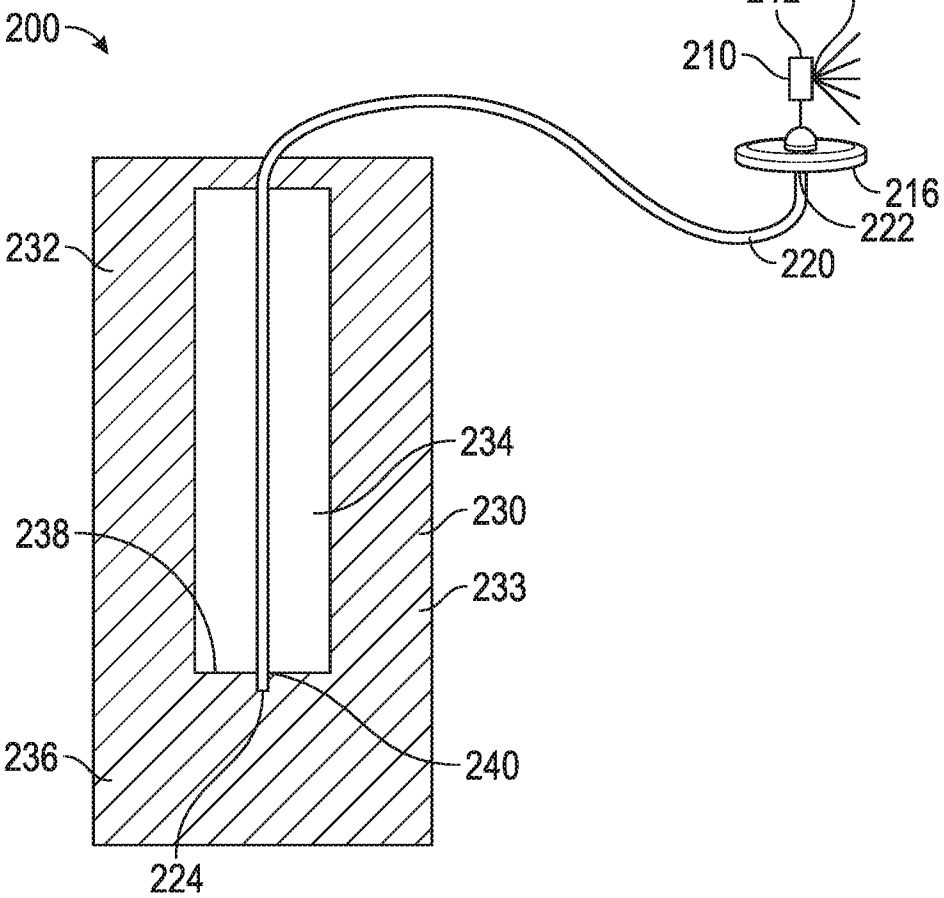
FIG. 9 is a sectional view of the spray can of FIG. 8 with the spray valve removed from the can.
Figure 8:
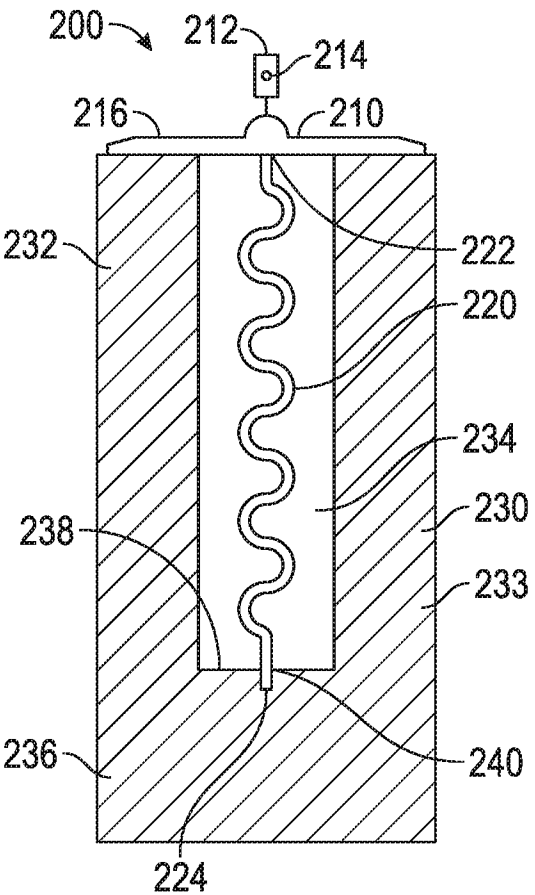
FIG. 8 is a cross-sectional view of a spray can with a removable spray valve according to an exemplary embodiment of the invention.

FIGS. 8 and 9 show a spray can assembly 200 with a removable spray valve assembly 210. Spray valve assembly 210 is removably attached to a spray can 230, such as by friction fit, screw thread, or other known releasable connection. Spray valve assembly 210 includes a nozzle 212 with a discharge port 214 for discharging pressurized contents of can 230. Nozzle 212 is mounted on a base plate 216 such that depression of nozzle 212 toward base plate 216 opens a valve (not shown) inside assembly 210 to allow the contents of can 230 to be discharged.

A flexible tube 220 has a first end 222 that is mounted to the bottom of base plate 216 and provides fluid communication between can 230 and the valve. A second end 224 of tube 220 is in direct fluid communication with the contents of can 230.

Can 230 has a content storage portion 232 in which contents of can 230 are stored. A top portion 233 of content storage portion 232 is annularly shaped with an open central void 234 that stores tube 220 when assembly 210 is mounted on can 230. A bottom portion 236 of content storage portion 232 allows for content to be stored within the entire perimeter of can 230. A top surface 238 of bottom portion 236 has a through-opening 240 formed therein such that second end 224 of tube 220 extends through through-opening 240 and into bottom portion 236.

To use assembly 200, spray valve assembly 210 is removed from can 230. A user holds spray valve assembly 210 and depresses nozzle 212 toward base plate 216, opening the valve inside spray valve assembly 210 and providing for fluid communication so that contents of can 230 flow from can 230, through tube 220, past the open valve for discharge from discharge port 214 of nozzle 212.

A benefit of assembly 200 is that can 230 does not need to be held, but can be placed on a surface or attached to the user, such as on a belt. Tube 220 allows spray valve assembly 210 to move over the surface to be sprayed without having to move can 230, which can provide for easier and more effective use of spray valve assembly 210.

Figure 10:
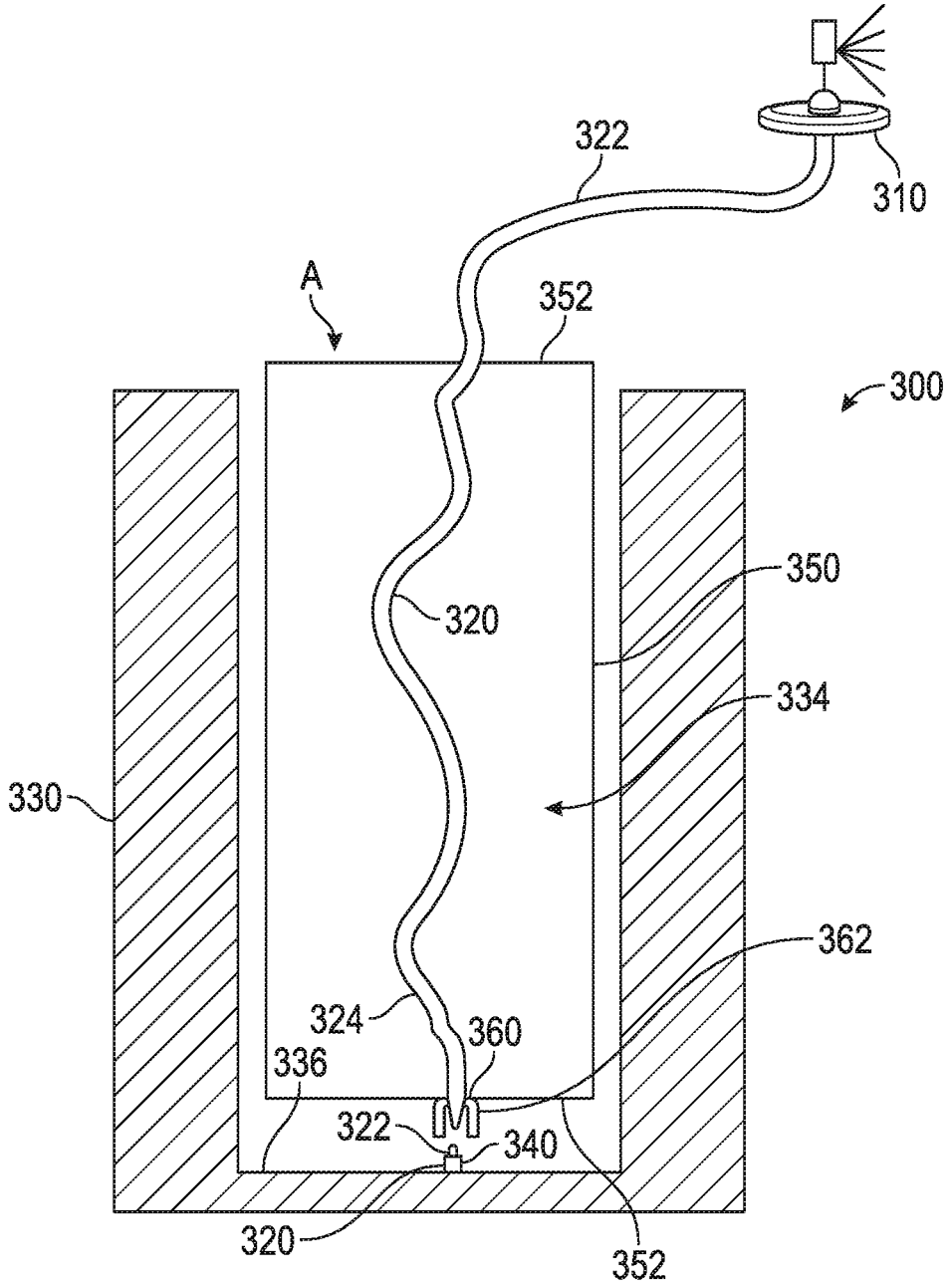
FIG. 10 is a sectional view of a spray can according to an alternative exemplary embodiment of the invention.

FIG. 10 shows an alternative embodiment of a spray can assembly 300. Assembly 300 includes a valve 320 inside a can 330 at through-opening 340 in a bottom portion 336 of can 330. Valve 320 can be a Schrader type valve or other suitable type of valve.

A sleeve 350 is removably inserted into a central void 334 in can 330. Sleeve 350 can be connected to can 330 at a top end 352 of sleeve 350, such as by a threaded connection, a snap fit, or other suitable connection. A flexible tube 320 extends into sleeve 350, with a top end 322 connected to a spray valve assembly 310 and a bottom end 324 connected to a pin 360 that extends downwardly from the bottom 352 of sleeve 350.

A shroud 362 is disposed around pin 360 such that, when sleeve 350 is fully inserted into central void 334 in the direction of arrow "A", pin 360 pushes down on a valve head 322 of valve 320 while shroud 362 extends around the exterior of valve 320, preventing the pressurized content from can 330 from leaking from valve 320. Pin 360 pushing down on valve head 322 opens valve 320. Pressurized content from inside can 350 flows through and out of valve 320 and into bottom end 324 of tube 320 for discharge from spray valve assembly 310.

It will be further understood that various changes in the details, materials, and arrangements of the parts which have been described and illustrated in order to explain the nature of this invention may be made by those skilled in the art without departing from the scope of the invention as expressed in the following claims.

I claim:

1. A nozzle assembly comprising:

an adapter configured for insertion into a pressurized container, wherein a nozzle has been removed from the pressurized container;

a flexible tubing having a first end connected to the adapter and a second end configured to extend outwardly of the pressurized container;

a discharge nozzle connected to the second end of the tubing, the discharge nozzle having an actuator button configured to selectively activate the discharge nozzle;

a discharge device, wherein the discharge nozzle is adapted to be removably inserted into the discharge device, wherein the discharge device comprises a trigger configured to activate the discharge nozzle, wherein the discharge device comprises a manifold adapted to receive a plurality of discharge nozzles, and wherein the discharge device comprises a handle and wherein the manifold is rotatably mounted on the handle.

2. The nozzle assembly according to claim 1, wherein the adapter comprises a hollow pin adapted to be inserted into the pressurized container.

3. The nozzle assembly according to claim 2, wherein the adapter comprises a flange connected to the hollow pin.

4. The nozzle assembly according to claim 1, wherein the adapter further comprises a check valve inserted therein.

5. The nozzle assembly according to claim 4, wherein the check valve comprises a ball, a seat, and a biasing member adapted to bias the ball against the seat.

6. The nozzle assembly according to claim 1, wherein the discharge nozzle is releasably connected to the tubing.

7. The nozzle assembly according to claim 1, further comprising an activating device, wherein, when the adapter is inserted into the pressurized container, and the adapter and the pressurized container are inserted into the activating device, operation of the activating device discharges fluid from the pressurized container and through the adapter.

8. The nozzle assembly according to claim 1, wherein the manifold comprises an activating rod adapted to engage each of the plurality of discharge nozzles.

9. The nozzle assembly according to claim 8, wherein the activating rod is operatively connected to the trigger.

10. A nozzle assembly comprising:

an adapter configured for insertion into a pressurized container, wherein a nozzle has been removed from the pressurized container;

a flexible tubing having a first end connected to the adapter and a second end configured to extend outwardly of the pressurized container;

a discharge nozzle connected to the second end of the tubing, the discharge nozzle having an actuator button configured to selectively activate the discharge nozzle; and a manifold adapted to receive a plurality of discharge nozzles, and wherein the discharge device comprises a handle and wherein the manifold is rotatably mounted on the handle.

11. The nozzle assembly according to claim 10, further comprising an activating device adapted to depress the hollow pin into the pressurized container.

12. The nozzle assembly according to claim 11, wherein the activating device comprises a caulking gun.

13. The nozzle assembly according to claim 11, wherein the flange is adapted to engage the activating device.

14. The nozzle assembly according to claim 10, further comprising a discharge device releasably attachable to the discharge nozzle such that operation of the discharge device allows a pressurized fluid to be discharged from the discharge nozzle.

15. The nozzle assembly according to claim 14, wherein the discharge device comprises a plurality of receivers adapted to each releasably receive one of a plurality of discharge nozzles.

16. The nozzle assembly according to claim 14, wherein the discharge device comprises a trigger.

* * * * *